US006191419B1

(12) United States Patent
Sinha

(10) Patent No.: US 6,191,419 B1
(45) Date of Patent: Feb. 20, 2001

(54) MACHINED ELECTROSTATIC SECTOR FOR MASS SPECTROMETER

(75) Inventor: Mahadeva P. Sinha, Temple City, CA (US)

(73) Assignee: California Institute of Technology, Pasadena, CA (US)

( * ) Notice: Under 35 U.S.C. 154(b), the term of this patent shall be extended for 0 days.

(21) Appl. No.: 09/130,548

(22) Filed: Aug. 6, 1998

Related U.S. Application Data

(60) Provisional application No. 60/054,891, filed on Aug. 6, 1997.

(51) Int. Cl.[7] ..... H01J 49/28
(52) U.S. Cl. ..... 250/294; 250/396 R
(58) Field of Search ..... 250/294, 396 R, 250/296

(56) References Cited

U.S. PATENT DOCUMENTS

| | | | | |
|---|---|---|---|---|
| 4,785,172 | | 11/1988 | Kubena et al. | 250/309 |
| 4,859,848 | * | 8/1989 | Bowman et al. | 250/396 R |
| 5,569,915 | | 10/1996 | Purser et al. | 250/281 |
| 5,801,380 | | 9/1998 | Sinha | 250/299 |

* cited by examiner

*Primary Examiner*—Jack Berman
(74) *Attorney, Agent, or Firm*—Fish & Richardson P.C.

(57) ABSTRACT

An electrostatic sector device for a mass spectrometer is formed from a single piece of machinable ceramic. The machined ceramic is coated with a nickel coating, and a notch is etched in the nickel coating to form two separated portions. The sector can be covered by a cover formed from a separate piece of machined ceramic.

12 Claims, 3 Drawing Sheets

MACHINED ELECTROSTATIC SECTOR FOR MASS SPECTROMETER

CROSS REFERENCE TO RELATED APPLICATIONS

This application claims the benefit of the U.S. Provisional Application No. 60/054,891, filed on Aug. 6, 1997, which is incorporated herein by reference.

STATEMENT AS TO FEDRALLY SPONSORED RESEARCH

The invention described herein was made in the performance of work under a NASA contract, and is subject to the provisions of Public Law 96-517(35 U.S.C. 202) in which the Contractor has elected to retain title.

BACKGROUND

The present invention describes an improved electrostatic sector used in miniaturized mass spectrometry applications.

Much effort has been placed on miniaturization of a high performance mass spectrometer. Such could be used in many applications. Terrestrial applications would include measuring toxic and hazardous chemicals in field and industrial environments. Space applications include chemical and isotopic analysis of materials on extraterrestrial bodies. Minimization of weight are important for both these applications.

FIG. 1 shows a double-focusing mass spectrometer incorporating an electrostatic sector. Other details of the miniaturization of such mass spectrometers are found in our co-pending application numbers 08/600,861 and 08/881,705. This device is in the so-called Mattauch-Herzon geometry. The system described in this application is ideally used with a microbore, micromachined column gas chromatograph in order to analyze organic mixtures.

The mass spectrometer part is shown in FIG. 1. MS 99 includes an ion source 100 producing ion beam 101 passing through the object slit 102. Ion beam 101 continues through electrostatic sector 104 and then through a magnetic sector 107 where it is spatially dispersed according to masses of the particles along the focal plane and measured by a detector array 106. The electrostatic sector acts as an energy analyzer of the ions in the ion beams 101. Much of this is described in our co-pending application.

The electrostatic sector for such a mass spectrometer requires high precision fabrication. Moreover, it is important to properly align the electrostatic sector with other components of the analyzer. The two rails shown as 110 and 112 of the electrostatic sector require tight tolerance. For example, a common tolerance dimension is 5 to 10 $\mu$m of parallelism for both the Y and Z directions where the ion motion is defined as the X direction in FIG. 1.

A complex and high precision housing to accommodate these rails is hence required.

These significant requirements have increased the cost of fabrication of such an electrostatic sector. These also increase the weight and volume of the electrostatic sector drastically. Alignment of the electrostatic sector with the rest of the mass is different and time consuming. Such electrostatic sectors are typically not sufficiently robust for field and space applications.

SUMMARY OF THE INVENTION

An electrostatic sector formed by machining a single piece of machinable insulator into a desired shape is described. A separate cover is also used. Preferably, the material is MACOR ceramic, but alumina could alternatively be used.

While the electrostatic sector is preferably used with the miniaturized device shown in FIG. 1, it could be used with any such spectrographic system.

BRIEF DESCRIPTION OF THE DRAWINGS

These and other aspects of the invention will be described with reference to the accompanying drawings, wherein.

DESCRIPTION OF THE PREFERRED EMBODIMENTS

The electrostatic sector of the present system is formed from a single piece of machinable insulator that has desirable vacumn properties—low outgassing and ability to hold a vacumn. Preferably, MACOR™ type ceramic or another type ceramic is used. Alumina (aluminum oxide) can alternatively be used.

The ceramic body is preferably machined to form an internal cavity of the proper dimension. A cover 210 can be ceramic or some other material.

Figure 3B:
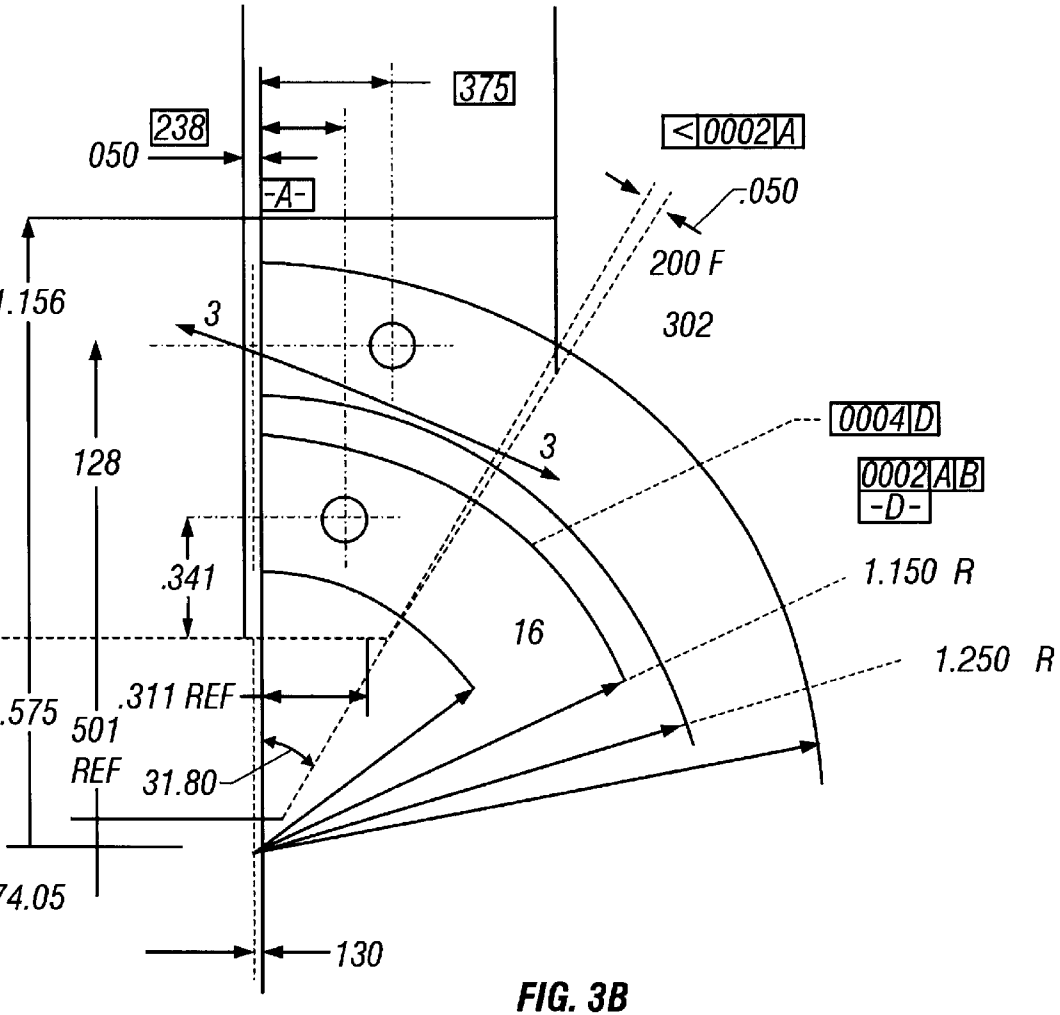
FIGS. 3A and 3B show drawings of the electrostatic analyzer part made of machinable ceramic.
Figure 3A:
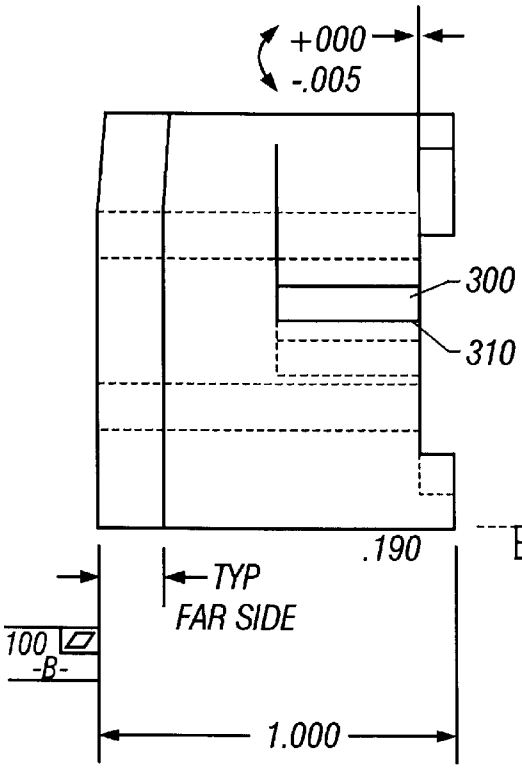
Figure 4A:
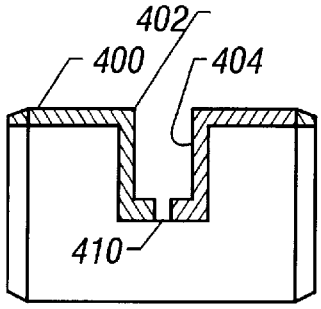
FIG. 4A shows a cross section of the sector.
Figure 4B:
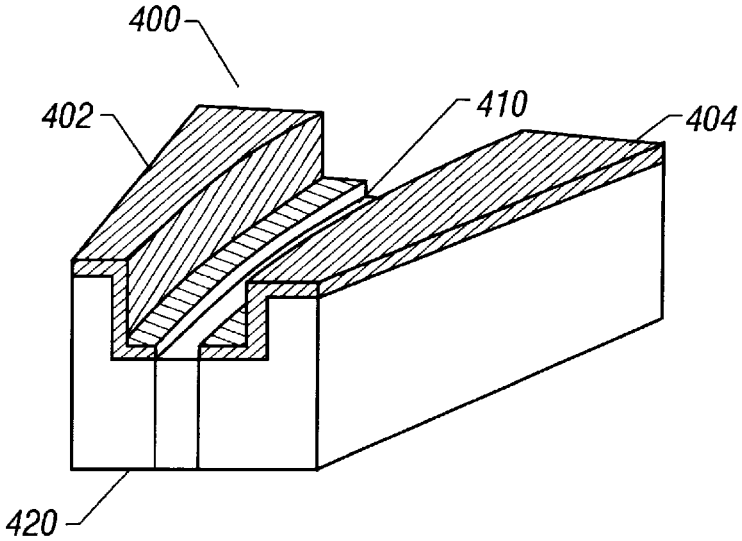
FIG. 4B shows a perspective view of the sector.
Figure 4C:
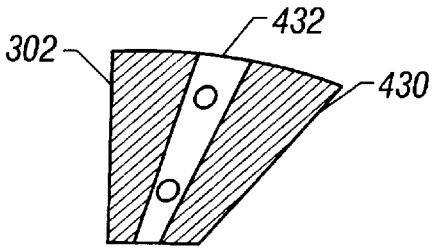
FIG. 4C shows a top of the unit.

Sector rails are machined in the ceramic. FIG. 3A shows a view of the ceramic piece from the top. FIG. 3B shows a cross-section along the line 3—3, showing certain parameters of the ceramic. Ridge 300 that is machined into the MACOR block. The inside faces of ridge 300 form the electrostatic sector rails. Any desired size could be selected; however, the ridge is preferably ~0.1 inches wide and 0.5 inches deep, following a shallow curve with a main radius of 30.5 mm in this embodiment.

MACOR is an insulator. The two inside faces of the rails that are carved in the block are made electrically conductive in order to form the electrostatic sector. The rails forming the two sides are also insulated from each other. Hence, once the ridge is formed as 300, the two sides are nickel or gold plated to form a covering nickel layer 400 of a thickness greater than 6 microns. Nickel coating is carried out throughout the unit both inside and outside in order to maintain parallelism between the faces of the electric sector rails 402, 404. Coating the outside allows grounding to avoid collection of charges on the device.

An insulated break section 410 of the nickel coating 0.5 mm wide, along the central region of the inside area of the cavity 300, is removed. Two side faces and the upper region of the unit also have a corresponding piece 420 removed so that the insulating portion goes all the way around the unit. Hence the section 402 of the coated device is insulated from the section 404 of the coated device.

A top plate 302 is also fabricated from the MACOR material. The top plate can also be nickel coated. The nickel is also notched 432 to maintain electrical isolation of the two rails.

Figure 1:
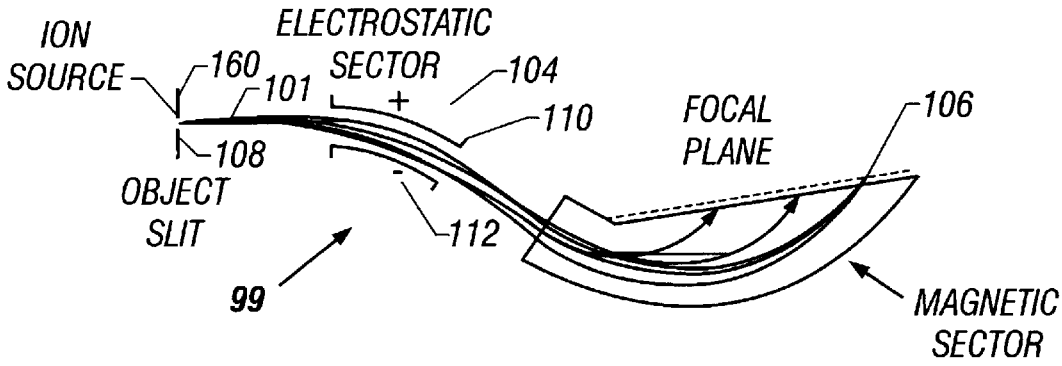
FIG. 1 shows a prior art focal plane type mass spectrometer of a Mattauch-Herzog geometry.
Figure 2:
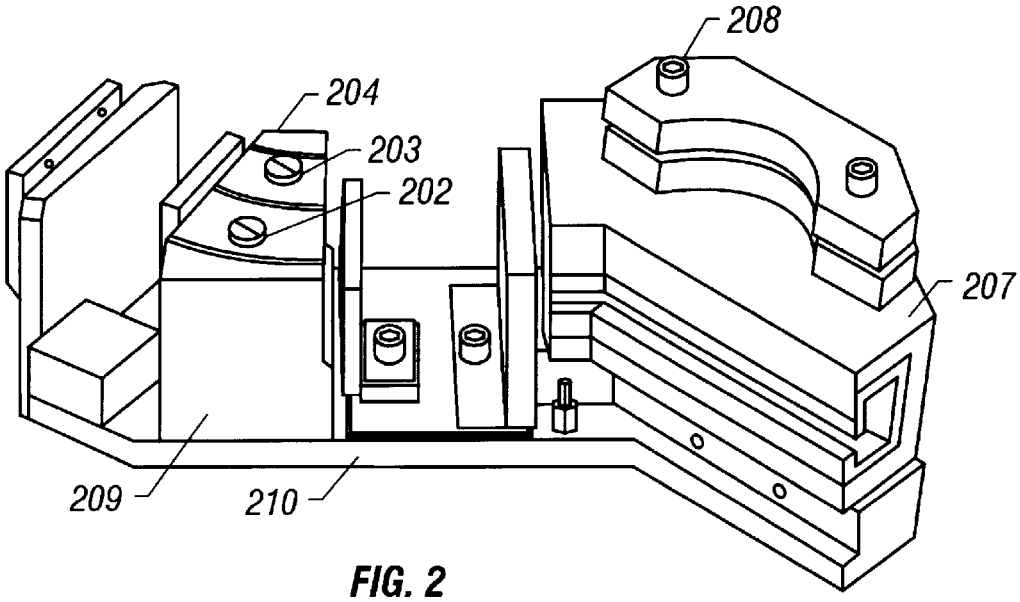
FIG. 2 shows a photograph of the miniaturized mass spectrometer in scale showing relative sizes of the different features.

The mass spectrometer shown in FIG. 2 includes alignment ridges 200 on both sides of the electrostatic sector.

Alignment of the electrostatic sector is carried out by positioning the holding element 202 along those alignment ridges. The holding element can include screws 203 with insulated washers 204 in order to isolate the holding element from the nickel coated cover and the rails of the electrostatic sector. All the regions of the electrostatic device which are not intended to be maintained at the desired potential are instead electrically connected and grounded to the base plate 210.

Important features of the electrostatic device include the following. The electrostatic device is compact, and separation and parallelism between the rail faces is naturally maintained. The unit is also relatively light, e.g. 30 grams. Well known ceramic machining techniques can be used for machining the internal dimensions of the device, thereby providing good accuracy in the specific dimensions. The nickel coating also allows good electrical conduction, and high accuracy in determining the locations of potential and insulation.

While nickel has been described as the preferred coating, any conductive material which can be coated on ceramic could alternatively be used.

The notch can be formed by masking before coating the nickel, or by machining out a notch in the nickel coating.

Although only a few embodiments have been described in detail above, other embodiments are contemplated by the inventor and are intended to be encompassed within the following claims. In addition, other modifications are contemplated and are also intended to be covered.

What is claimed is:

1. An electrostatic sector for a mass spectrometer device, comprising:

a housing, formed by a machined piece of insulating ceramic material of a type that has a desirable vacuum property, said machined piece of ceramic defining an outer perimeter and an inner slot area which is substantially curved over an entire extent thereof, so that its walls are always parallel to one another, and extends only partially through said machined piece of ceramic, said walls of said inner slot area forming the electrostatic sector; and a conductive coating, coated on at least some, but not all of said walls of said slot area, and a portion where said conductive film is not coated defining an insulating gap separating said conductive coating into first and second separated conductive portions.

2. A sector as in claim 1 wherein said conductive coating is nickel or gold.

3. A sector as in claim 1 wherein said ceramic material is Macor material, and said conductive coating is a coating of nickel.

4. A sector as in claim 1 further comprising a cover for said electrostatic sector, said cover formed of the same Macor material as said housing.

5. A sector as in claim 4 wherein said cover includes a non conductive gap etched therein at a similar location to the location of the insulating gap, and aligned therewith so that the insulating gap aligns with the gap in said housing when said cover is attached.

6. A method of forming an electrostatic sector, comprising:

machining, from a top surface, a curved slot into a piece of nonconductive material that extends from said top surface into said material a distance less than the thickness of said material and forms a constant cross sectional slot to form a housing;

forming a conductive coating on part, but not all, of said non conductive material;

separating said material into a first conductive side and a second conductive side which are insulated from one another.

7. A method as in claim 6, wherein said conductive coating is metal.

8. A method as in claim 6, wherein said forming comprises:

forming a conductive coating, and etching an insulating gap into said conductive coating to form said separated sides.

9. A method as in claim 6, further comprising forming a cover, which has a conductive coating and with an insulating gap in said conductive coating substantially parallel with said insulating gap in said conductive coating.

10. A method as in claim 6 wherein said forming comprises:

masking a specified area prior to conductive coating which electrically separates said conductive coating into a first part and a second part;

applying a conductive material over an entire exterior of said sector; and removing said mask to leave a separation between said conductive materials.

11. A method as in claim 6 further comprising forming a cover of a piece of non conductive material that is of the same material as said sector;

forming a conductive coating on said separating said conductive coating into a first conductor side and a second conductor side which are insulated from one another; and aligning the first and second conductor sides with said first and second conductor sides of said housing separations such that when the cover is attached on the housing, it aligns with a separation on the device.

12. An electrostatic sector device comprising:

a housing, formed of a machined piece of insulating ceramic material with a desired vacuum property, having an outer perimeter and an inner slot area which is substantially curved along an entire length of said inner slot area, all the way from a first end of inner slot area at a first edge of said housing to a second end of said inner slot area at a second edge of said housing;

a conductive coating, including a coating over an entire area thereof except for over an insulating gap which separates said coating into a first side and a second side with the insulating gap therebetween, said housing including an attachment mechanism allowing a cover to be attached thereto, and a cover, formed of the same material as said housing, and also coated with the same material that coats said housing, and also having an insulating gap thereon, said insulating gap being aligned to the insulating gap in said housing, such that when said cover is attached, the cover makes electrical contact at respective sides which said first and second sides, respectively.

* * * * *